US007348720B2

(12) United States Patent
Kim et al.

(10) Patent No.: US 7,348,720 B2
(45) Date of Patent: Mar. 25, 2008

(54) ELECTRON EMISSION DEVICE AND ELECTRON EMISSION DISPLAY INCLUDING THE SAME

(75) Inventors: Si-Myeong Kim, Kyunggi-do (KR); Il-Hwan Kim, Kyunggi-do (KR); Seung-Joon Yoo, Kyunggi-do (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 308 days.

(21) Appl. No.: 11/085,261

(22) Filed: Mar. 22, 2005

(65) Prior Publication Data

US 2005/0218787 A1 Oct. 6, 2005

(30) Foreign Application Priority Data

Mar. 30, 2004 (KR) ..... 10-2004-0021860

(51) Int. Cl.
*H01J 1/62* (2006.01)

(52) U.S. Cl. ..... 313/495; 313/497; 313/309; 313/310; 313/336

(58) Field of Classification Search ..... None
See application file for complete search history.

(56) References Cited

U.S. PATENT DOCUMENTS 5,386,172 A * 1/1995 Komatsu ..... 313/309
6,064,149 A * 5/2000 Raina ..... 313/497
6,285,123 B1 * 9/2001 Yamada et al. ..... 313/495
6,313,572 B1 * 11/2001 Yamada ..... 313/310
6,617,798 B2 * 9/2003 Lee et al. ..... 315/169.3
2004/0036409 A1 * 2/2004 Oh et al. ..... 313/495
2004/0222734 A1 * 11/2004 Oh ..... 313/497
2007/0029921 A1 * 2/2007 Jin et al. ..... 313/495

FOREIGN PATENT DOCUMENTS

JP 2003-234062 8/2003
KR 102001008149 8/2001
WO WO 9949492 A1 * 9/1999

* cited by examiner

*Primary Examiner*—Vip Patel
(74) *Attorney, Agent, or Firm*—Robert E. Bushnell, Esq.

(57) ABSTRACT

An electron emission device includes: a substrate; first and second electrodes insulated from each other and arranged on the substrate and having predetermined shapes; an electron emission region arranged on the substrate; and a first passivation layer entirely covering at least one of the first and second electrodes and exposing at least a portion of the electron emission region. An electron emission display includes: first and second substrates opposed to each other; first and second electrodes insulated from each other and arranged transversely to each other on the first substrate and having predetermined shapes; an electron emission region arranged on the substrate; a first passivation layer entirely covering at least one of the first and second electrodes and exposing at least a portion of the electron emission region; and an image display substrate having an anode electrode and a fluorescent layer arranged on the second substrate.

17 Claims, 4 Drawing Sheets

ELECTRON EMISSION DEVICE AND ELECTRON EMISSION DISPLAY INCLUDING THE SAME

CLAIM OF PRIORITY

This application makes reference to, incorporates the same herein, and claims all benefits accruing under 35 U.S.C. 119 from an application entitled ELECTRON EMISSION DEVICE AND ELECTRON EMISSION DISPLAY COMPRISING THE SAME, earlier filed in the Korean Intellectual Property Office on 30 Mar. 2004 and there duly assigned Serial No. 2004-21860.

BACKGROUND OF THE INVENTION

1. Field of the Invention

The present invention relates to an electron emission device, and an electron emission display including the electron emission device.

2. Description of the Related Art

Generally, an electron emission device is classified as either a hot cathode type and a cold cathode type, wherein the hot cathode type and the cold cathode type employ a hot cathode and a cold cathode as an electron emission source respectively. A cold cathode type electron emission device comprises a structure such as a Field Emitter Array (FEA), a Surface Conduction Emitter (SCE), a Metal Insulating Layer Metal (MIM), a Metal Insulating Layer Semiconductor (MIS), and Ballistic Electron Surface Emitting (BSE).

The foregoing electron emission devices are employed for an electron emission display, various backlighting, and a lithography electron beam. Among these, the electron emission display comprises an electron emission substrate provided with the electron emission device to emit electrons, and an image display substrate in which the emitted electrons collide with a fluorescent material to emit light. Generally, the electron emission display comprises: a plurality of electron emission devices formed on a first substrate, driving electrodes to control the electron emission of electron emission devices, a fluorescent layer formed on a second substrate and colliding with the electrons emitted from the first substrate, and a focusing electrode to accelerate the electrons toward the fluorescent layer.

In the electron emission display, while the electrons are emitted, an arc can be generated due to a high voltage within an internal space limited by an anode substrate and a cathode substrate. Here, the anode substrate corresponds to the electron emission substrate and the cathode substrate corresponds to the image display substrate. The higher the voltage applied to the anode electrode, the greater the probability that an arc is likely to be generated. In more detail, when a voltage of 1 kV or more is applied to the anode electrode, an arc is likely to be generated. In the structure in which the cathode substrate and the anode substrate are coupled with a spacer, it is difficult to maintain a level of brightness in a stable manner. The arc generation causes the electrodes formed as a thin film to be damaged, thereby deteriorating stability. Besides, a gate electrode, a cathode electrode or a metal mesh can include a protrusion and foreign material, which causes an electric field to be non-uniform, thereby causing abnormal light-emission and arcing. Accordingly, there has been proposed an electron emission display comprising an electron emission device having an improved structure capable of preventing arcing due to the high voltage.

An example of an electron emission display having an arcing prevention structure is discussed in Korean Patent First Publication No. 2001-0081496.

Such an electron emission display comprises a first substrate, a second substrate, and a spacer provided between the first and second substrates to maintain a constant distance therebetween. A cathode electrode having a stripe shape, a dielectric layer, and a gate electrode having a stripe shape situated transversely to the cathode electrode are formed in sequence on the second substrate. A micro tip is formed on the cathode electrode as an electron emitter. An anode electrode having a stripe shape situated transversely to the cathode electrode is formed on a first substrate opposed to the second substrate. A fluorescent layer facing the second substrate is formed on the anode electrode. A grid electrode is formed between the gate electrode and the anode electrode to control the electrons emitted from the micro tip.

With such a configuration, even though a high voltage is applied, the electric field applied to the gate electrode is not high, so that arcing is substantially prevented and an anode voltage is prevented from being partially applied to the cathode electrode.

However, in such an electron emission display having the foregoing configuration, the grid electrode is employed as an optional element for focusing the electrons and intercepting the electric field. Therefore, an additional process is needed to form the grid electrode. Furthermore, the protrusion and the foreign material of the grid electrode cause the electric field to be non-uniform, so that problems such as abnormal light-emission and arcing still arise.

SUMMARY OF THE INVENTION

Accordingly, it is an aspect of the present invention to provide an electron emission device which is fabricated by a simple process and having a top electrode protected from anode arcing.

Another aspect of the present invention is to provide an electron emission display which comprises a passivation layer to protect a top electrode, formed on a thick dielectric layer, against a high anode voltage applied thereto.

The foregoing and/or other aspects of the present invention are achieved by providing an electron emission device comprising: a substrate; first and second electrodes insulated from each other and arranged on the substrate, the first and second electrodes having predetermined shapes; an electron emission region arranged on the substrate; and a first passivation layer covering at least one of the first and second electrodes and exposing at least a portion of the electron emission region.

The first and second electrodes are preferably arranged on the same plane.

Alternatively, the first and second electrodes are preferably arranged on different planes.

The electron emission device preferably further comprises a dielectric layer arranged between the first and second electrodes.

The passivation layer preferably comprises a dielectric oxide thin film including either magnesium oxide (MgO) or silicon oxide ($SiO_x$).

The electron emission device preferably further comprises: a third electrode including an opening through which electrons emitted by the electron emission region pass and are focused; and a second passivation layer arranged on at least one side of the third electrode.

The second passivation layer preferably comprises a dielectric oxide thin film including either magnesium oxide (MgO) or a silicon oxide ($SiO_x$).

The electron emission region preferably comprises at least one material selected from a group consisting of nano-tubes, nano-wires, nano-fibers, graphite, diamond, and Diamond-Like Carbon (DLC).

The foregoing and/or other aspects of the present invention are also achieved by providing an electron emission display comprising: a first substrate and a second substrate opposed to each other; first and second electrodes insulated from each other and arranged transversely to each other on the first substrate, the first and second electrodes having predetermined shapes; an electron emission region arranged on the first substrate; a first passivation layer covering at least one of the first and second electrodes and exposing at least a portion of the electron emission region; and an image display substrate having an anode electrode and a fluorescent layer formed on the second substrate.

The first and second electrodes are preferably arranged on the same plane.

Alternatively, the first and second electrodes are preferably arranged on different planes.

The electron emission display preferably further comprises a dielectric layer arranged between the first and second electrodes.

The passivation layer preferably comprises a dielectric oxide thin film including either magnesium oxide (MgO) or silicon oxide ($SiO_x$).

The electron emission display preferably further comprises: a third electrode including an opening through which electrons emitted by the electron emission region pass and are focused; and a second passivation layer arranged on at least one side of the third electrode.

The second passivation layer preferably comprises a dielectric oxide thin film including either magnesium oxide (MgO) or silicon oxide ($SiO_x$).

The electron emission region preferably comprises at least one material selected from a group consisting of nano-tubes, nano-wires, nano-fibers, graphite, diamond, and Diamond-Like Carbon (DLC).

The electron emission display preferably further comprises an optical interception film arranged on an inner surface of the second substrate facing the first substrate.

The electron emission display preferably further comprises a metal reflecting film arranged on an inner surface of the second substrate facing the first substrate.

The electron emission display preferably further comprises a spacer supporting the first substrate and the second substrate to be spaced apart from each other.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
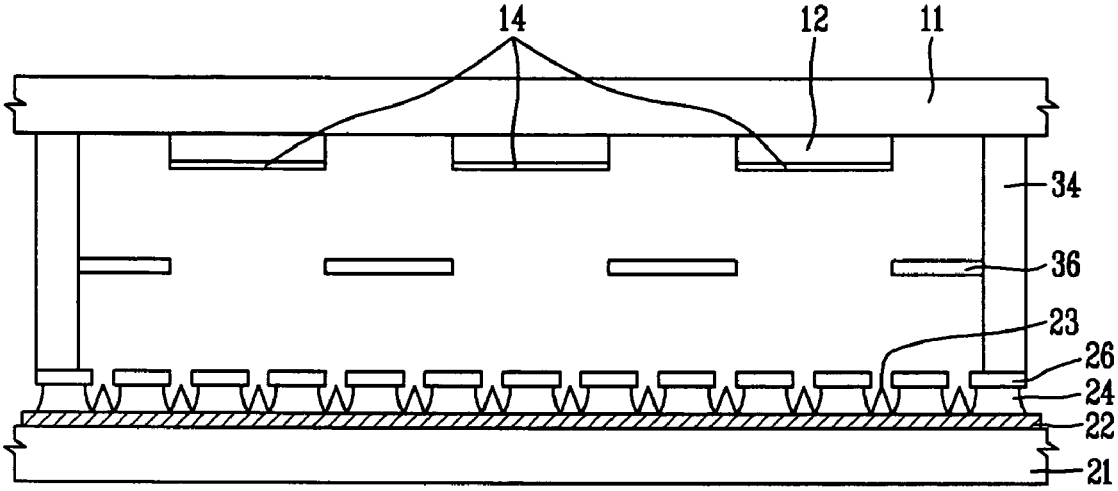
FIG.1 (PRIOR ART)
FIG. 1 is a schematic sectional view of an earlier electron emission display.

FIG. 1 is a schematic sectional view of an earlier electron emission display.

Referring to FIG. 1, the electron emission display comprises a first substrate 11, a second substrate 21, and a spacer 34 provided between the first and second substrates 11 and 21 to maintain a constant distance therebetween. A cathode electrode 22 having a stripe shape, a dielectric layer 24, and a gate electrode 26 having a stripe shape situated transversely to the cathode electrode 22 are formed in sequence on the second substrate 21. A micro tip 23 is formed on the cathode electrode 22 as an electron emission region. An anode electrode 12 having a stripe shape situated transversely to the cathode electrode 22 is formed on a first substrate 11 opposed to the second substrate 21. A fluorescent layer 14 facing the second substrate 21 is formed on the anode electrode 12. A grid electrode 36 is formed between the gate electrode 26 and the anode electrode 12 to control the electrons emitted from the micro tip 23.

With the configuration shown in FIG. 1, even though a high voltage is applied, the electric field applied to the gate electrode 26 is not high, so that arcing is substantially prevented and an anode voltage is prevented from being partially applied to the cathode electrode 22.

Hereinafter, exemplary embodiments of the present invention will be described in detail with reference to the accompanying drawings. As readily understood by those skilled in the art, various modifications to these embodiments within the scope of the present invention are possible and the present invention is not limited to the embodiments disclosed herein.

Figure 2:
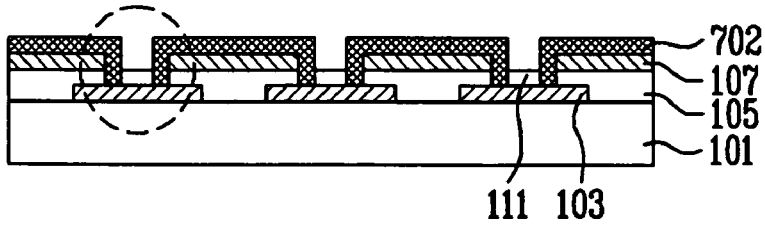
FIG. 2 is a schematic sectional view of an electron emission device according to a first embodiment of the present invention.

FIG. 2 is a schematic sectional view of an electron emission device according to a first embodiment of the present invention.

Referring to FIG. 2, the electron emission device comprises a substrate 101, a first electrode 103 and a second electrode 107 insulated from each other and arranged to have a predetermined shape on the substrate 101, an electron emission region 111 connected the first electrode 103, and a first passivation layer 702 covering the first and second electrodes 103 and 107 and exposing a portion or the entire electron emission region 111 therethrough. The first electrode 103 and the second electrode 107 are formed on different planes.

In more detail, the substrate 101 can be made of various materials, for example, glass or glass excluding impurities such as sodium (Na), and can be made of a silicon plate formed with a dielectric layer such as silicon dioxide ($SiO_2$) or the like and a ceramic plate.

A cathode electrode 103 having a predetermined pattern, e.g., a stripe shape, is formed on the substrate 101. Here, the cathode electrode corresponds to the first electrode. A dielectric layer 105 is formed on the cathode electrode 103. A gate electrode 107 having a stripe shape transversely to the cathode electrode 103 is formed on the dielectric layer 105. Here, the gate electrode corresponds to the second electrode. A hole is formed on the dielectric layer 105 on the cathode electrode 103, and the electron emission region 111 is formed on the cathode electrode 103 exposed through the hole. The gate electrode 107 is formed with an opening corresponding to the hole, so that the electrons emitted from the electron emission region 111 flow to an anode substrate (not shown) through the opening.

The electron emission region 111 is made of nano-tubes such as a carbon nano-tubes (CNTs), nano-wires, nano-fibers, graphite, diamond, diamond-like carbon (DLC), or a combination thereof.

The first passivation layer 702 is made of a dielectric oxide. The dielectric oxide includes a magnesium oxide (MgO) and a silicon oxide ($SiO_x$). The first passivation layer 702 is applied to the entire area of the cathode substrate except for a region above of the electron emission region 111. The first passivation layer 702 is formed by a deposition or screen process and then dried and annealed. With this configuration, the top-gate electrode of the electron emission device is protected from anode arcing.

Furthermore, a grid electrode (not shown) formed with an opening through which the electrons emitted from the electron emission region 111 pass, and a second passivation layer (not shown) formed on at least one side of the grid electrode are additionally provided, so that the electrodes exposed to a high voltage applied to the anode electrode (not shown) are protected, thereby preventing arc generation due to the high voltage.

The first passivation layer 702 and the second passivation layer are formed as a dielectric thin film selectively including either magnesium oxide (MgO) or a silicon oxide ($SiO_x$), wherein the reason why the magnesium oxide (MgO) and the silicon oxide ($SiO_x$) are used is because they both can be coated on the gate electrode 107 and the grid electrode as a thin film.

According to an aspect of the present invention, the cathode substrate having the electron emission device is covered with the passivation layer, so that the cathode substrate including the gate electrode is protected from the anode arcing, thereby enhancing the reliability of the electron emission device.

Figure 3:
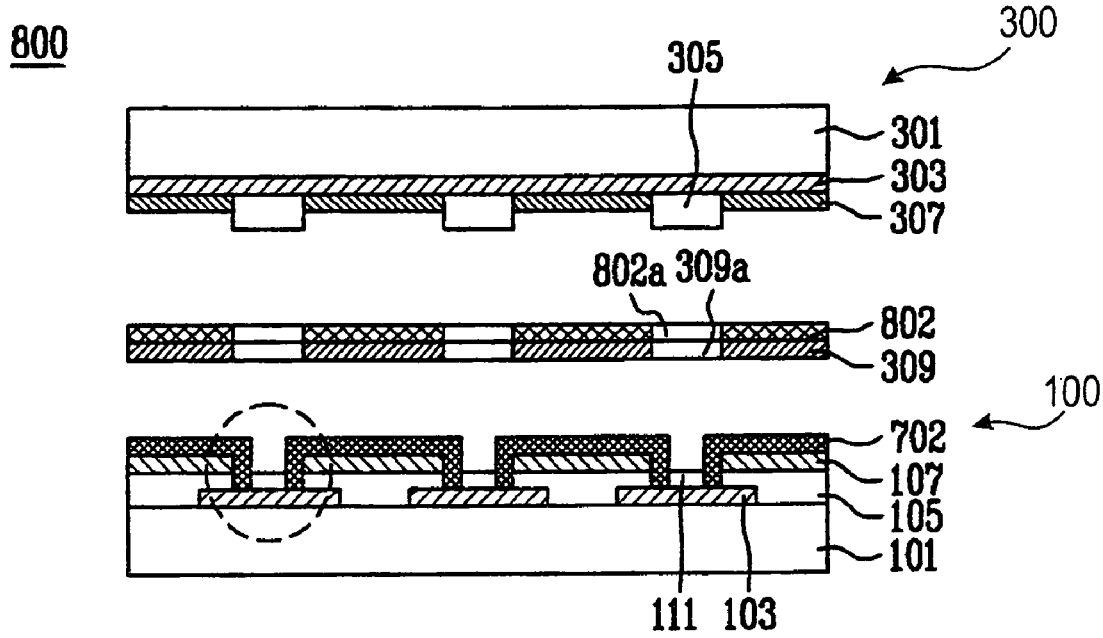
FIG. 3 is a schematic sectional view of an electron emission display including an electron emission device according to a second embodiment of the present invention.

FIG. 3 is a schematic sectional view of an electron emission display including an electron emission device according to a second embodiment of the present invention.

Referring to FIG. 3, the electron emission display 800 comprises a first substrate 101 and a second substrate 301 opposed to each other; a first electrode 103 and a second electrode 107 insulated from each other and arranged transversely to each other, and having stripe shapes; an electron emission region 111 connected to one of the first and second electrodes 103 and 107; a first passivation layer 702 covering at least one of the first and second electrodes 103 and 107 and exposing a portion or the entire electron emission region 111; an image display substrate having an anode electrode 303 and a fluorescent layer 305 on the second substrate 301. The first electrode 103 and the second electrode 107 are formed on different planes. Furthermore, a third electrode 309 formed with an opening through which the electrons emitted from the electron emission region 111 pass, and a second passivation layer 802 formed on at least one side of the third electrode 309 are also provided. The first passivation layer 702 and the second passivation layer 802 are formed as a dielectric thin film selectively including either magnesium oxide (MgO) or silicon oxide ($SiO_x$).

In more detail, the electron emission display 800 comprises a cathode substrate 100, an anode substrate 300, and a grid electrode 309 provided between the cathode substrate 100 and the anode substrate 300. Furthermore, the electron emission display 800 additionally comprises the second passivation layer 802 coated on a surface of the grid electrode 309 facing the anode substrate 300.

The anode substrate 300 comprises the second substrate 301, the anode electrode 303 formed on the substrate 301, and the fluorescent layer 305 formed on the anode electrode 303 and having a stripe shape. An optical interception film 307 can be additionally provided between the fluorescent layers 305. Here, the anode substrate 300 corresponds to an image display substrate.

The cathode substrate 100 is the same as that illustrated in the FIG. 2, and therefore repetitive descriptions have been omitted. Furthermore, a spacer (not shown) is provided between the anode substrate 300 and the cathode substrate 100 and maintains a predetermined distance between the anode substrate 300 and the cathode substrate 100.

The grid electrode 309 is formed with a hole 309*a* through which the electrons emitted from the electron emission region 111 flow. Furthermore, the grid electrode 309 absorbs the electrons which do not travel toward a fluorescent material 305 among the electrons emitted from the electron emission region 111. The grid electrode 309 can be replaced by a conductive metal mesh deflecting the electrons emitted from the electron emission region 111. Furthermore, an optical interception film 307 is additionally provided on an inner surface of the anode substrate 300 facing toward the cathode substrate 100. Also, a metal reflecting film (not shown) can be additionally provided to enhance electron-focusing efficiency and to enhance light-emission efficiency of the fluorescent layer 305.

With this configuration, in the electron emission display 800, the cathode substrate 100 is coated with the first passivation layer 702 and the grid electrode 309 is coated with the second passivation layer 802, so that the top electrode of the cathode substrate 100 and the grid electrode 309 are prevented from being damaged due to the anode arcing. Furthermore, a non-uniform electric field due to a protrusion and/or a foreign material of the grid electrode 309 is prevented, thereby preventing abnormal light-emission and arcing.

The grid electrode 309 is fabricated separately from the cathode substrate 100 and the anode substrate 300 and is then coupled to the cathode substrate 100 and the anode substrate 300. Hence, the second passivation layer 802 is first formed on the grid electrode 309 and the grid electrode 309 is then coupled to the cathode substrate 100 and the anode substrate 300. The second passivation layer 802 is additionally formed on at least one side of the grid electrode 309 and protects the electrodes exposed to the high voltage applied to the anode electrode 303, so that the probability of an arc is lowered even though a high voltage is applied.

Thus, in the electron emission display according to an embodiment of the present invention, the anode electrode can be supplied with a voltage of 4 kV or more, so that a high efficiency fluorescent material can be applied to the electron emission display.

Figure 4:
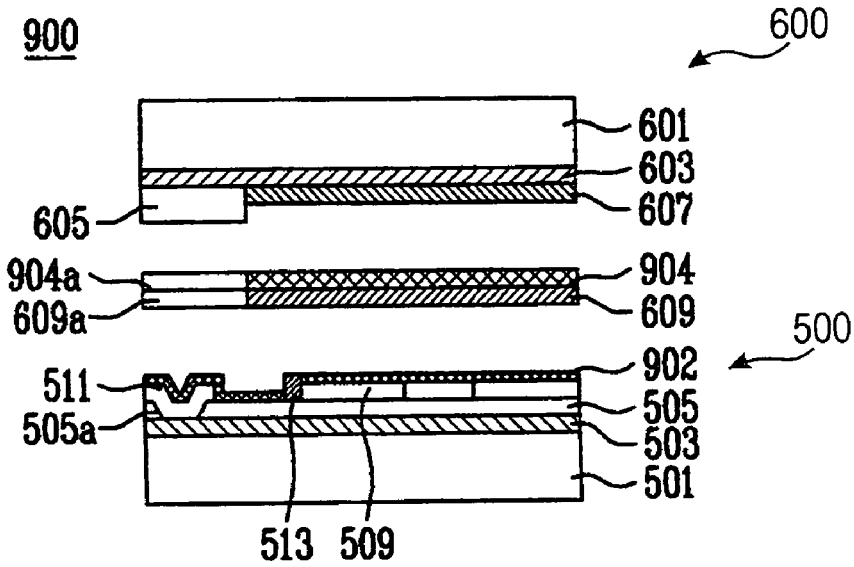
FIG. 4 is a schematic sectional view of an electron emission display including an electron emission device according to a third embodiment of the present invention.

FIG. 4 is a schematic sectional view of an electron emission display including an electron emission device according to a third embodiment of the present invention.

Referring to FIG. 4, the electron emission display 900 according to another aspect of the present invention comprises a first substrate 501 and a second substrate 601 opposite each other, a first electrode 509 and a second electrode 503 insulated from each other and arranged transversely to each other and having predetermined shapes, an electron emission region 513 connected to the first electrode 509, a first passivation layer 902 covering the first electrode 509 and a counter electrode 511 and exposing a portion of or the entire electron emission region 513, an image display substrate having an anode electrode 603 and a fluorescent layer 605 on the second substrate 601. The first electrode 509 and the counter electrode 511 are formed on the substantially same plane.

Furthermore, a third electrode 609 formed with an opening 609*a* through which the electrons emitted from the electron emission region 513 pass and a second passivation layer 904 formed on at least one side of the third electrode 609 are additionally provided. The first passivation layer 902 and the second passivation layer 904 are formed as a dielectric thin film including either magnesium oxide (MgO) or silicon oxide ($SiO_x$).

In more detail, the electron emission display 900 comprises a cathode substrate 500 comprising a first substrate 501, a gate electrode 503, a dielectric layer 505, a cathode electrode 509, a counter electrode 511, an electron emission region 513, and a first passivation layer 902. Furthermore, the electron emission display 900 comprises an anode substrate 600 comprising a second substrate 601, an anode electrode 603, a fluorescent layer 605, and an optional element such as an optical interception film 607. Still furthermore, the electron emission display 900 comprises a grid electrode 609 placed between the cathode substrate 500 and the anode substrate 600. The grid electrode 609 is coated with a second passivation layer 904. The optical interception film 607 can be additionally formed on an inner surface of the second substrate 601. Also, a metal reflecting film (not shown) can be additionally provided on an inner surface of the second substrate 601 to enhance electron-focusing efficiency and to enhance light-emission efficiency of the fluorescent layer 605.

Both first and second substrates 501 and 601 are made of a transparent material. The transparent material includes a vitreous material. The gate electrode 503 is made of a conductive material and is formed by a deposition or screen process and then dried and annealed. The gate electrode 503 is patterned to have a stripe shape for matrix-driving of the electron emission display, which is extended along a first direction. In the case of the screen process, the patterning process can be omitted.

The thickness of the dielectric layer 505 interposed between the gate electrode 503 and the cathode electrode 509 facing each other is selected to allow a voltage applied between the gate electrode 503 and the cathode electrode 509 to have a predetermined value. Furthermore, the dielectric layer 505 is formed with a via hole 505*a*, so that the counter electrode 511 can be formed and connected to the under-gate electrode 503.

The electron emission region 513 is made of a material selected from a group consisting of nano-tubes such as carbon nano-tubes (CNTs), nano-wires, fullerene ($C_{60}$), diamond-like carbon (DLC), and graphite, or a combination thereof. Furthermore, the electron emission region 513 at least partially contacts the cathode electrode 509.

The first passivation layer 902 is made of a dielectric oxide, and covers the entire area of the cathode substrate but a portion is occupied by the electron emission region 513 from which electrons are emitted. The dielectric oxide for the first passivation layer 902 includes either magnesium oxide (MgO) or silicon oxide ($SiO_x$). The first passivation layer 902 is formed by a screen process and then dried and annealed.

The grid electrode 609 is employed for absorbing the electrons emitted by the electron emission region 513 toward a strange region. The grid electrode 609 has a rough surface. Thus, the grid electrode 609 causes a non-uniform electric field within itself because of its protrusion, and/or foreign materials. To prevent this non-uniform electric field, the grid electrode 609 is coated with the second passivation layer.

The second passivation layer 904 is formed on the grid electrode 609 having a hole 609*a* therethrough which electrons emitted from the electron emission source 513 pass. Therefore, the second passivation layer 904 is formed with a hole 904*a* corresponding to the hole 609*a* of the grid electrode 609. Furthermore, the second passivation layer 904 is made of a dielectric oxide like the first passivation layer 902 and is deposited on the grid electrode 609 before placing the grid electrode 609 between the cathode substrate 500 and the anode substrate 600. The dielectric oxide for the second passivation layer 904 includes either magnesium oxide (MgO) or silicon oxide ($SiO_x$) like the first passivation layer 902. Magnesium oxide (MgO) or silicon oxide ($SiO_x$) is used because they can be coated as a thin film on the gate electrode 503 and the grid electrode 609.

Thus, in the electron emission display 900, the top-counter electrode, the top-cathode electrode, and the electron emission region are protected from the anode arcing. Furthermore, according to an embodiment of the present invention, the grid electrode formed on the cathode substrate is coated with the passivation layer, thereby preventing a non-uniform electric field due to protrusions, foreign material, or the like, within the grid electrode. Hence, in the electron emission display according to an embodiment of the present invention, it is possible to increase the voltage applied to the anode electrode to 4 kV or more, so that a high efficiency fluorescent material can be applied to the electron emission display.

Below, a method of fabricating the electron emission device employed in the electron emission display according to an embodiment of the present invention is described with reference to FIGS. 5A through 6C. FIGS. 5A through 6C illustrate a portion of the electron emission device corresponding to that taken along a circle of FIG. 2.

Figure 5A:
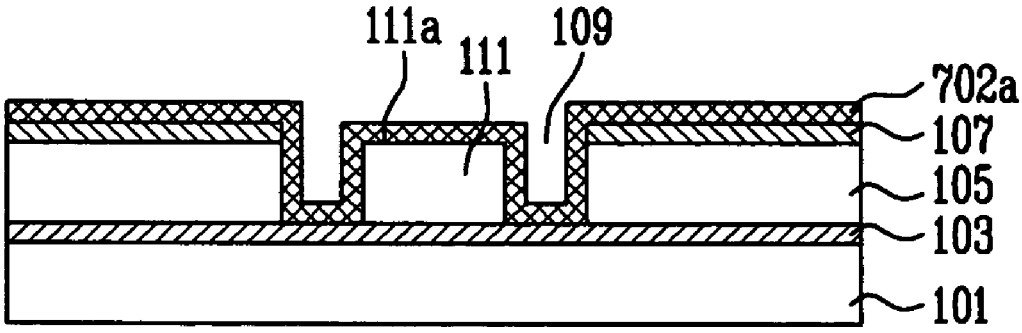
FIGS. 5A and 5B are schematic sectional views of a method of fabricating an electron emission device used in an electron emission display according to a fourth embodiment of the present invention.
Figure 5B:
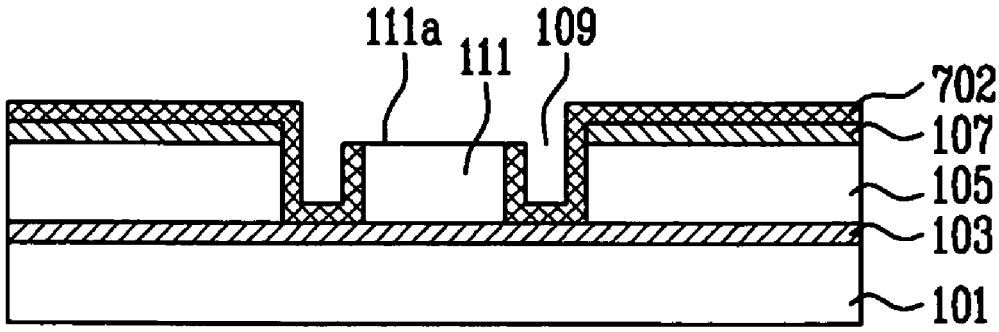

FIGS. 5A and 5B are schematic sectional views of a method of fabricating an electron emission device used in an electron emission display according to a fourth embodiment of the present invention.

Referring to FIGS. 5A and 5B, a method of fabricating an electron emission device comprises: forming a first electrode 103 on a substrate 101 to have a predetermined shape in a first direction, forming a dielectric layer 105 on the substrate 101 and the first electrode 103, forming a second electrode 107 on the dielectric layer 105, forming a hole through both the second electrode 107 and the dielectric layer 105 to expose a portion of the first electrode 103, forming an electron emission region 111 placed within the hole and connected to the first electrode 103, and forming a passivation layer 702 covering both the second electrode 107 and an inner wall of the hole and exposing a portion of the electron emission region 111.

In more detail, referring to FIG. 5A, a cathode electrode 103, a dielectric layer 105, a gate electrode 107, a CNT 111, and a passivation layer 702 are formed on a substrate 101 in sequence. An Indium Tin Oxide (ITO) is first formed on the entire area of the substrate 101, and then the ITO is patterned to form the cathode electrode 103. In the case of a matrix-driving structure, the cathode electrode has a stripe shape.

The dielectric layer 105 is then formed on the entire area of the cathode electrode 103.

Then, a metal layer (not shown) is deposited on the dielectric layer 105, and is patterned as the gate electrode 107.

A gate hole 109 is then formed through the metal layer and the dielectric layer 105.

The whole area of the substrate 101 formed with the gate electrode 107 is then coated with a sacrificial layer (not shown). The sacrificial layer is formed to expose the cathode electrode 103 in a region for forming an electron emission region within a gate hole 109.

Then, a carbon nano-tube paste is applied to the whole area of the sacrificial layer so as to form the electron emission region 111. The CNT paste is thickly formed by a screen process and then dried. The CNT paste is applied via the sacrificial layer formed in the gate hole 109, thereby having a width of the electron emission region smaller than that of the gate hole 109.

The CNT paste is then back-exposed and developed.

The passivation layer 702*a* is then formed over the entire area of the cathode substrate comprising the substrate 101, the cathode electrode 103, the dielectric layer 105, the gate electrode 107, and the CNT 111. The top surface 111*a* of the CNT 111 is also covered with the passivation layer 702*a*.

The passivation layer 702*a* is made of a dielectric oxide which includes either magnesium oxide (MgO) or silicon oxide ($SiO_x$). Furthermore, the passivation layer 702*a* is thickly deposited. Alternatively, the passivation layer 702*a* can be thinly deposited, but in this case, there arises a problem in that electrons are likely to be emitted from the electrode made of a metal ceramic film and provided under the thin passivation layer 702*a* via the thin passivation layer 702*a*. Therefore, it is preferable that the passivation layer 702*a* is thickly formed to prevent electrons from being readily emitted from under the electrode. For example, the passivation layer 702*a* has a thickness of 1 μm or more. More preferably, the passivation layer 702*a* has a thickness between 1 μm and 30 μm.

On the other hand, the CNT 111 can be annealed before forming the passivation layer 702*a* on the whole area of the cathode substrate comprising the cathode electrode 103, the dielectric layer 105, the gate electrode 107, and the CNT 111.

As illustrated in FIG. 5B, the passivation layer 702*a* formed on the surface 111*a* of the CNT 111 is removed by an activation process using a adhesive tape. Thus, the electron emission display with the passivation layer 702 is fabricated.

Figure 6A:
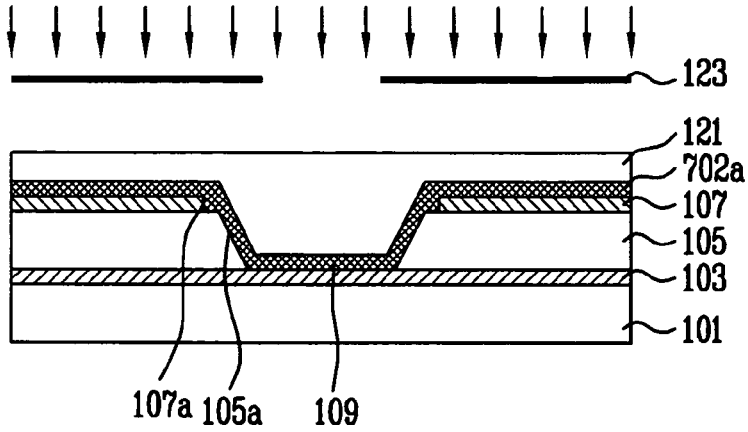
FIGS. 6A through 6C are schematic sectional views of a method of fabricating an electron emission device used in an electron emission display according to a fifth embodiment of the present invention.
Figure 6B:
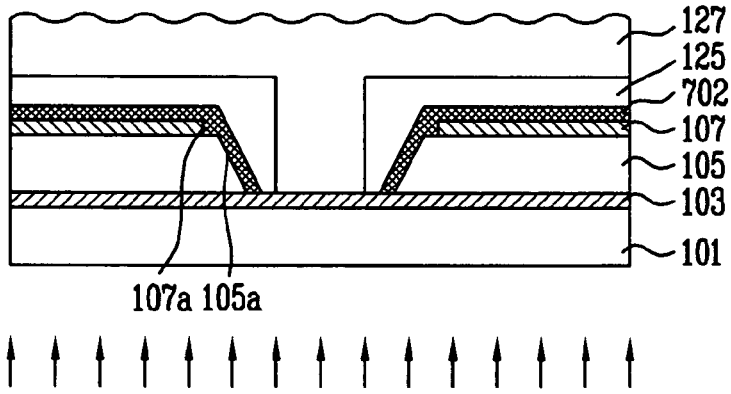
Figure 6C:
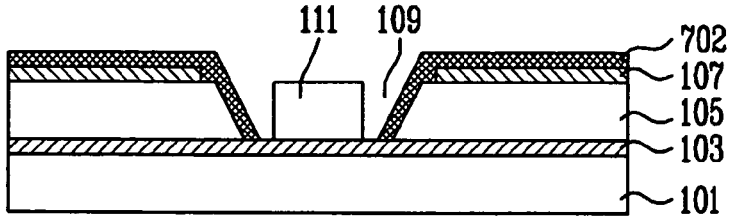

Below, a method of fabricating an electron emission device employed in an electron emission display according to another embodiment of the present invention is described. FIGS. 6A through 6C are schematic sectional views of a method of fabricating an electron emission device used in an electron emission display according to a fifth embodiment of the present invention.

Referring to FIGS. 6A through 6C, a method of fabricating an electron emission device comprises: forming a first electrode 103 on a substrate 101 to have a predetermined shape in a first direction, forming a dielectric layer 105 on the substrate 101 and the first electrode 103, forming a second electrode 107 on the dielectric layer 105, forming a hole through both the second electrode 107 and the dielectric layer 105 to expose a portion of the first electrode 103, forming a passivation layer 702 covering both the second electrode 107 and an inner wall of the hole and exposing a portion of the first electrode 103, and forming an electron emission region 111 on the first electrode 103 exposed through the passivation layer 702.

In more detail, referring to FIG. 6A, a cathode electrode 103, a dielectric layer 105, a gate electrode 107, and a gate hole 109 are first formed on a substrate 101 in sequence by the same methods as described referring to FIG. 5A.

Then, a passivation layer 702*a* is formed on the whole area of the substrate 101 comprising the cathode electrode 103, the dielectric layer 105, the gate electrode 107, and the gate hole 109. The passivation layer 702*a* is made of either magnesium oxide (MgO) or silicon oxide ($SiO_x$). Furthermore, the passivation layer 702*a* is formed by a deposition process.

Then, a photoresist layer 121 is formed on the whole area of the passivation layer 702*a*. The photoresist layer 121 is exposed through a mask 123 formed with a pattern for the electron emission region, and then developed. Through this process, the photoresist layer 121 is used as a mask layer (not shown) for etching the passivation layer 702*a*.

Referring to FIG. 6B, the passivation layer 702*a* within the gate hole 109 is etched though the photoresist layer 121 employed as the mask layer. Through this process, a first passivation layer 702 is formed.

Then, a sacrificial layer 125 is formed on the first passivation layer 702. Subsequently, the sacrificial layer 125 is processed by exposure and development to form a predetermined pattern. Such a patterned sacrificial layer 125 is used for forming a CNT 111 within the gate hole 109 by the following back exposure process.

A CNT paste 127 is printed on the sacrificial layer 125 by the screen process and then dried. Then, the back exposure process is applied to the cathode substrate, and the sacrificial layer 125 and an unexposed portion of the CNT paste 127 are removed. Afterwards, an annealing process is applied to the cathode substrate, and a CNT surface treatment is performed as necessary. Through these processes, the electron emission display comprising the cathode substrate with the first passivation layer 702 is fabricated as shown in FIG. 6C.

In the foregoing embodiment, the method of fabricating the cathode substrate of the electron emission display having the top-gate structure was described. However, it would be appreciated by those skilled in the art that this method can be employed in fabricating a cathode substrate of an electron emission display having an under-gate structure.

Furthermore, it would be appreciated by those skilled in the art that the foregoing method can be employed in fabricating an electron emission display comprising a cathode substrate, an anode substrate and a grid electrode.

In the above-described embodiment, a triode electron emission display is described. However, the present invention is applicable to an electron emission display having various electrode structures such as a diode structure, a tetrode structure, or the like. Thus, it is apparent that the present invention is not limited to the triode electron emission display and a method of fabricating the same.

As described above, the present invention provides an electron emission display which is fabricated by a simple process and of which a top thin film electrode of a cathode substrate is protected from anode arcing.

Furthermore, the present invention provides an electron emission display of which an electrode formed on a thick dielectric layer is protected and endures high anode voltage.

Still furthermore, the present invention provides an electron emission display to which high anode voltage can be applied, thereby increasing light-emission efficiency of the fluorescent material.

Although exemplary embodiments of the present invention have been shown and described, it would be appreciated by those skilled in the art that modifications can be made to these embodiments without departing from the principles and spirit of the present invention, the scope of which is defined by the claims below.

What is claimed is:

1. An electron emission device comprising:

a substrate;

first and second electrodes insulated from each other and arranged on the substrate, the first and second electrodes having predetermined shapes;

an electron emission region arranged on the substrate and directly contacting the first electrode; and a first passivation layer entirely covering at least one of the first and second electrodes and exposing at least a portion of the electron emission region.

2. The electron emission device according to claim 1, wherein the first and second electrodes are arranged on different planes, both different planes being parallel to the substrate.

3. The electron emission device according to claim 1, further comprising a dielectric layer arranged between the first and second electrodes.

4. The electron emission device according to claim 1, wherein the first passivation layer comprises a dielectric oxide thin film including either magnesium oxide (MgO) or silicon oxide ($SiO_x$).

5. The electron emission device according to claim 1, further comprising:

a third electrode including an opening through which electrons emitted by the electron emission region pass and are focused; and a second passivation layer arranged on at least one side of the third electrode.

6. The electron emission device according to claim 5, wherein the second passivation layer comprises a dielectric oxide thin film including either magnesium oxide (MgO) or a silicon oxide ($SiO_x$).

7. The electron emission device according to claim 1, wherein the electron emission region comprises at least one material selected from a group consisting of nano-tubes, nano-wires, nano-fibers, graphite, diamond, and Diamond-Like Carbon (DLC).

8. An electron emission display comprising:

a first substrate and a second substrate opposed to each other;

first and second electrodes insulated from each other and arranged transversely to each other on the first substrate, the first and second electrodes having predetermined shapes;

an electron emission region arranged on the first substrate and directly contacting the first electrode;

a first passivation layer entirely covering at least one of the first and second electrodes and exposing at least a portion of the electron emission region; and an image display substrate having an anode electrode and a fluorescent layer arranged on the second substrate.

9. The electron emission display according to claim 8, wherein the first and second electrodes are arranged on different planes, both different planes being parallel to the first substrate.

10. The electron emission display according to claim 8, further comprising a dielectric layer arranged between the first and second electrodes.

11. The electron emission display according to claim 8, wherein the first passivation layer comprises a dielectric oxide thin film including either magnesium oxide (MgO) or silicon oxide ($SiO_x$).

12. The electron emission display according to claim 8, further comprising:

a third electrode including an opening through which electrons emitted by the electron emission region pass and are focused; and a second passivation layer arranged on at least one side of the third electrode.

13. The electron emission display according to claim 12, wherein the second passivation layer comprises a dielectric oxide thin film including either magnesium oxide (MgO) or silicon oxide ($SiO_x$).

14. The electron emission display according to claim 8, wherein the electron emission region comprises at least one material selected from a group consisting of nano-tubes, nano-wires, nano-fibers, graphite, diamond, and Diamond-Like Carbon (DLC).

15. The electron emission display according to claim 8, further comprising an optical interception film arranged on an inner surface of the second substrate facing the first substrate.

16. The electron emission display according to claim 8, further comprising a metal reflecting film arranged on an inner surface of the second substrate facing the first substrate.

17. The electron emission display according to claim 8, further comprising a spacer supporting the first substrate and the second substrate to be spaced apart from each other.

* * * * *